US008358256B2

(12) United States Patent
Hamer et al.

(10) Patent No.: US 8,358,256 B2
(45) Date of Patent: Jan. 22, 2013

(54) COMPENSATED DRIVE SIGNAL FOR ELECTROLUMINESCENT DISPLAY

(75) Inventors: John W. Hamer, Rochester, NY (US); Gary Parrett, Rochester, NY (US); Charles I. Levey, West Henrietta, NY (US)

(73) Assignee: Global OLED Technology LLC, Herndon, VA (US)

( * ) Notice: Subject to any disclaimer, the term of this patent is extended or adjusted under 35 U.S.C. 154(b) by 728 days.

(21) Appl. No.: 12/272,222

(22) Filed: Nov. 17, 2008

(65) Prior Publication Data

US 2010/0123649 A1 May 20, 2010

(51) Int. Cl.
*G09G 3/30* (2006.01)

(52) U.S. Cl. ..... 345/77; 345/904

(58) Field of Classification Search ..... 345/77, 345/904; 324/760.01; 348/180
See application file for complete search history.

(56) References Cited

U.S. PATENT DOCUMENTS

| | | | | |
|---|---|---|---|---|
| 6,081,073 | A | 6/2000 | Salam | |
| 6,414,661 | B1 | 7/2002 | Shen et al. | |
| 6,473,065 | B1 | 10/2002 | Fan | |
| 6,504,565 | B1 | 1/2003 | Narita et al. | |
| 6,995,519 | B2 | 2/2006 | Arnold et al. | |
| 7,928,936 | B2 * | 4/2011 | Levey et al. | 345/77 |
| 7,994,810 | B2 * | 8/2011 | Hayashi | 324/760.01 |
| 8,026,873 | B2 * | 9/2011 | Leon et al. | 345/76 |
| 2002/0267474 | | 11/2002 | Everitt | |
| 2003/0122813 | A1 | 7/2003 | Ishizuki et al. | |
| 2004/0100430 | A1 | 5/2004 | Fruehauf | |
| 2005/0007392 | A1 | 1/2005 | Kasai et al. | |
| 2006/0158402 | A1 * | 7/2006 | Nathan et al. | 345/82 |
| 2007/0195020 | A1 | 8/2007 | Nathan et al. | |
| 2008/0111812 | A1 * | 5/2008 | Shirasaki et al. | 345/76 |
| 2008/0315788 | A1 * | 12/2008 | Levey et al. | 315/291 |
| 2010/0225630 | A1 * | 9/2010 | Levey et al. | 345/211 |
| 2010/0225634 | A1 * | 9/2010 | Levey et al. | 345/212 |

FOREIGN PATENT DOCUMENTS

| | | |
|---|---|---|
| JP | 2002-278514 | 9/2002 |
| WO | WO 2005/109389 A1 | 11/2005 |

OTHER PUBLICATIONS

Kuo, Thin Film Transistors: Materials and Processes, vol. 2, Polycrystalline Thin Film Transistors, 2004, pp. 410-412
International Search Report dated Jan. 22, 2010.
Written Opinion of the International Searching Authority dated Nov. 4, 2009.

* cited by examiner

*Primary Examiner* — Kevin M Nguyen
*Assistant Examiner* — Sepideh Ghafari
(74) *Attorney, Agent, or Firm* — Morgan, Lewis & Bockius LLP

(57) ABSTRACT

Compensation is performed for initial nonuniformity or aging of drive transistors and electroluminescent (EL) emitters in 3T1C EL subpixels of an EL display, such as an organic light-emitting diode (OLED) display. A readout transistor connected to the EL emitter is used to readout the voltage of the emitter and compensation for $\Delta V_{th}$, $\Delta V_{EL}$, and OLED efficiency loss is performed using a model. Measurements are taken during a frame by driving a target subpixel at a higher luminance for a shorter time, then using the remaining time in the frame to measure. Measurements can be taken with an A/D converter or with a ramp generator and comparator. Compensation is performed for each subpixel individually.

11 Claims, 11 Drawing Sheets

COMPENSATED DRIVE SIGNAL FOR ELECTROLUMINESCENT DISPLAY

CROSS REFERENCE TO RELATED APPLICATIONS

Reference is made to commonly-assigned, co-pending U.S. patent application Ser. No. 11/766,823, filed Jun. 22, 2007, entitled "OLED Display with Aging and Efficiency Compensations" by Levey et al, and to commonly-assigned, co-pending U.S. patent application Ser. No. 11/962,182, filed Dec. 21, 2007, entitled "Electroluminescent Display Compensated Analog Transistor Drive Signal" by Leon et al, the disclosures of which are incorporated by reference herein.

FIELD OF THE INVENTION

The present invention relates to solid-state electroluminescent (EL) flat-panel displays, such as organic light-emitting diode (OLED) displays, and more particularly to such displays having a way to compensate for the aging of the electroluminescent display components.

BACKGROUND OF THE INVENTION

Electroluminescent (EL) devices have been known for some years and have been recently used in commercial display devices. Such devices employ both active-matrix and passive-matrix control schemes and can employ a plurality of subpixels. Each subpixel contains an EL emitter and a drive transistor for driving current through the EL emitter. The subpixels are typically arranged in two-dimensional arrays with a row and a column address for each subpixel, and having a data value associated with the subpixel. Subpixels of different colors, such as red, green, blue and white, are grouped to form pixels. EL displays can be made from various emitter technologies, including coatable-inorganic light-emitting diode, quantum-dot, and organic light-emitting diode (OLED).

OLED displays are of particular interest as a superior flat-panel display technology. These displays utilize current passing through thin films of organic material to generate light. The color of light emitted and the efficiency of the energy conversion from current to light are determined by the composition of the organic thin-film material. Different organic materials emit different colors of light. However, as the display is used, the organic materials in the display age and become less efficient at emitting light. This reduces the lifetime of the display. The differing organic materials can age at different rates, causing differential color aging and a display whose white point varies as the display is used. In addition, each individual pixel can age at a rate different from other pixels, resulting in display nonuniformity. Further, some circuitry elements, e.g. amorphous silicon transistors, are also known to exhibit aging effects.

The rate at which the materials age is related to the amount of current that passes through the display and, hence, the amount of light that has been emitted from the display. Various techniques to compensate for this aging effect have been described.

U.S. Pat. No. 6,414,661 B1 by Shen et al. describes a method and associated system to compensate for long-term variations in the light-emitting efficiency of individual organic light-emitting diodes (OLEDs) in an OLED display by calculating and predicting the decay in light output efficiency of each pixel based on the accumulated drive current applied to the pixel. The method derives a correction coefficient that is applied to the next drive current for each pixel. This technique requires the measurement and accumulation of drive current applied to each pixel, requiring a stored memory that must be continuously updated as the display is used, and therefore requiring complex and extensive circuitry.

U.S. Pat. No. 6,504,565 B1 by Narita et al. describes a similar method of holding the amount of light emitted from each light-emitting element constant. This design requires the use of a calculation unit responsive to each signal sent to each pixel to record usage, greatly increasing the complexity of the circuit design.

U.S. Patent Application Publication No. 2002/0167474 A1 by Everitt describes a pulse width modulation driver for an OLED display. One embodiment of a video display comprises a voltage driver for providing a selected voltage to drive an organic light-emitting diode in a video display. The voltage driver can receive voltage information from a correction table that accounts for aging, column resistance, row resistance, and other diode characteristics. In one embodiment of the invention, the correction tables are calculated prior to and/or during normal circuit operation. Since the OLED output light level is assumed to be linear with respect to OLED current, the correction scheme is based on sending a known current through the OLED diode for a duration sufficiently long to permit the transients to settle out, and then measuring the corresponding voltage with an analog-to-digital converter (A/D) residing on the column driver. A calibration current source and the A/D can be switched to any column through a switching matrix.

JP 2002-278514A by Numao describes a method in which current through and temperature of organic EL elements are measured. Compensation is then performed using precomputed tables and the current and temperature measurements. This design presumes a predictable relative use of pixels and does not accommodate differences in actual usage of groups of pixels or of individual pixels. Hence, correction for color or spatial groups is likely to be inaccurate over time. Moreover, the integration of temperature and multiple current sensing circuits within the display is required. This integration is complex, reduces manufacturing yields, and takes up space within the display.

U.S. Patent Application Publication No. 2003/0122813 A1 by Ishizuki et al. discloses a method which measures current for each subpixel in turn. The measurement techniques of this method are iterative, and therefore slow.

U.S. Pat. No. 6,995,519, by Arnold et al., teaches a method of compensating for aging of an OLED emitter. This method assumes that the entire change in device luminance is caused by changes in the OLED emitter. However, when the drive transistors in the circuit are formed from amorphous silicon (a-Si), this assumption is not valid, as the threshold voltage of the transistors also changes with use. This method will not provide complete compensation for OLED efficiency losses in circuits wherein transistors show aging effects. Additionally, when methods such as reverse bias are used to mitigate a-Si transistor threshold voltage shifts, compensation of OLED efficiency loss can become unreliable without appropriate tracking/prediction of reverse bias effects, or a direct measurement of the OLED voltage change or transistor threshold voltage change.

U.S. Patent Application Publication No. 2004/0100430 A1 by Fruehauf discloses a pixel structure having a third transistor which taps a diode driving current to supply a current-measuring circuit and a voltage comparison unit. However, this method reduces the efficiency of a display containing such pixels by using for measurement current which could have otherwise been used to emit light. Furthermore, this method only compensates for TFT variations and is unable to compensate for non-uniform OLED characteristics.

In addition to aging effects, some transistor technologies, such as low-temperature polysilicon (LTPS), can produce drive transistors that have varying mobilities and threshold voltages across the surface of a display (Kuo, Yue, ed. *Thin Film Transistors: Materials and Processes, vol. 2: Polycrystalline Thin Film Transistors*. Boston: Kluwer Academic Publishers, 2004, pg. 410-412). This produces objectionable visible nonuniformity. Further, nonuniform OLED material deposition can produce emitters with varying efficiencies, also causing objectionable nonuniformity. These nonuniformities are present at the time the panel is sold to an end user, and so are termed initial nonuniformities. FIG. 9 shows an example histogram of subpixel luminance for a flat field exhibiting differences in characteristics between pixels. Actual luminances varied by 20 percent in either direction, resulting in unacceptable display performance.

U.S. Pat. No. 6,081,073 by Salam describes a display matrix with a process and control circuitry for reducing brightness variations in the pixels. This disclosure describes the use of a linear scaling method for each pixel based on a ratio between the brightness of the weakest pixel in the display and the brightness of each pixel. However, this approach will lead to an overall reduction in the dynamic range and brightness of the display and a reduction and variation in the bit depth at which the pixels can be operated.

U.S. Pat. No. 6,473,065 B1 by Fan describes methods of improving the display uniformity of an OLED. The display characteristics of all organic-light-emitting-elements are measured. The technique uses a combination of look-up tables and calculation circuitry to implement uniformity correction. However, this method requires optical measurements. This makes it unsuitable for aging correction, which requires periodic measurement in the user's location. Further, the described approaches require either a separate lookup table for each pixel, resulting in very expensive memory requirements, or approximations to the characteristics of each pixel, reducing image quality.

U.S. Patent Application Publication No. 2005/0007392 A1 by Kasai et al. describes an electro-optical device that stabilizes display quality by performing correction processing corresponding to a plurality of disturbance factors, and using a conversion table whose description contents include correction factors. However, this method requires a large number of look-up tables (LUTs), not all of which are in use at any given time, to perform processing, and does not describe a method for populating those LUTs.

There is a need therefore for a more complete compensation approach for aging and initial nonuniformity of electroluminescent displays.

SUMMARY OF THE INVENTION

It is therefore an object of the present invention to compensate for aging and efficiency changes in electroluminescent emitters in the presence of transistor aging.

This object is achieved by a method of providing drive transistor control signals to drive transistors in a plurality of electroluminescent (EL) subpixels, comprising:

(a) providing a plurality of EL subpixels, each subpixel including a drive transistor having a first electrode, a second electrode and a gate electrode, an EL emitter having a first electrode and a second electrode, and a readout transistor having a first electrode, a second electrode and a gate electrode;

(b) connecting the first electrode of each readout transistor to the second electrode of the corresponding drive transistor and to the first electrode of the corresponding EL emitter;

(c) receiving for each subpixel an input code value which commands a corresponding output from the respective subpixel, (d) selecting a target subpixel;

(e) providing to each subpixel, except the target subpixel, the respective input code value, and providing to the target subpixel a boosted code value which commands a selected first amount higher output than the corresponding input code value;

(f) after a selected delay time, measuring a readout voltage on the second electrode of the readout transistor of the target subpixel to provide a status signal representing the characteristics of the drive transistor and EL emitter in that subpixel;

(g) using the status signal to provide a compensated code value for the target subpixel;

(h) providing a drive transistor control signal corresponding to the compensated code value to the drive transistor of the target EL subpixel; and (i) repeating steps (d) through (h), selecting each of the plurality of subpixels in turn as the target subpixel, to provide a respective drive transistor control signal to the drive transistor in each of the plurality of EL subpixels.

This aim is further achieved by an apparatus for providing a drive transistor control signal to the gate electrode of a drive transistor in an electroluminescent (EL) subpixel, comprising:

a) the EL subpixel including the drive transistor having first, second and gate electrodes, an EL emitter having first and second electrodes, and a readout transistor having a first electrode connected to the second electrode of the drive transistor and having a second electrode, wherein the first electrode of the EL emitter is connected to the second electrode of the drive transistor;

b) a measurement circuit for measuring a readout voltage on the second electrode of the readout transistor at different times to provide a status signal representing variations in the characteristics of the drive transistor and EL emitter caused by operation of the drive transistor and EL emitter over time;

c) means for providing an input code value;

d) a compensator for receiving an input code value and producing a compensated code value in response to the status signal; and e) a source driver for producing the drive transistor control signal in response to the compensated code value for driving the gate electrode of the drive transistor.

An advantage of this invention is an OLED display that compensates for the aging of the organic materials in the display wherein circuitry aging is also occurring, without requiring extensive or complex circuitry for accumulating a continuous measurement of light-emitting element use or time of operation. It is a further advantage of this invention that it uses simple voltage measurement circuitry. It is a further advantage of this invention that by making all measurements of voltage, it is more sensitive to changes than methods that measure current. It is a further advantage of this invention that compensation for changes in driving transistor properties can be performed with compensation for the OLED changes, thus providing a complete compensation solution. It is a further advantage of this invention that both aspects of measurement and compensation (OLED and driving transistor) can be accomplished rapidly. It is a further advantage of this invention that a single select line can be used to enable data input and data readout. It is a further advantage of this invention that characterization and compensation of driving transistor and OLED changes are unique to the specific element and are not impacted by other elements that may be open-circuited or short-circuited.

DETAILED DESCRIPTION OF THE INVENTION

Figure 1:
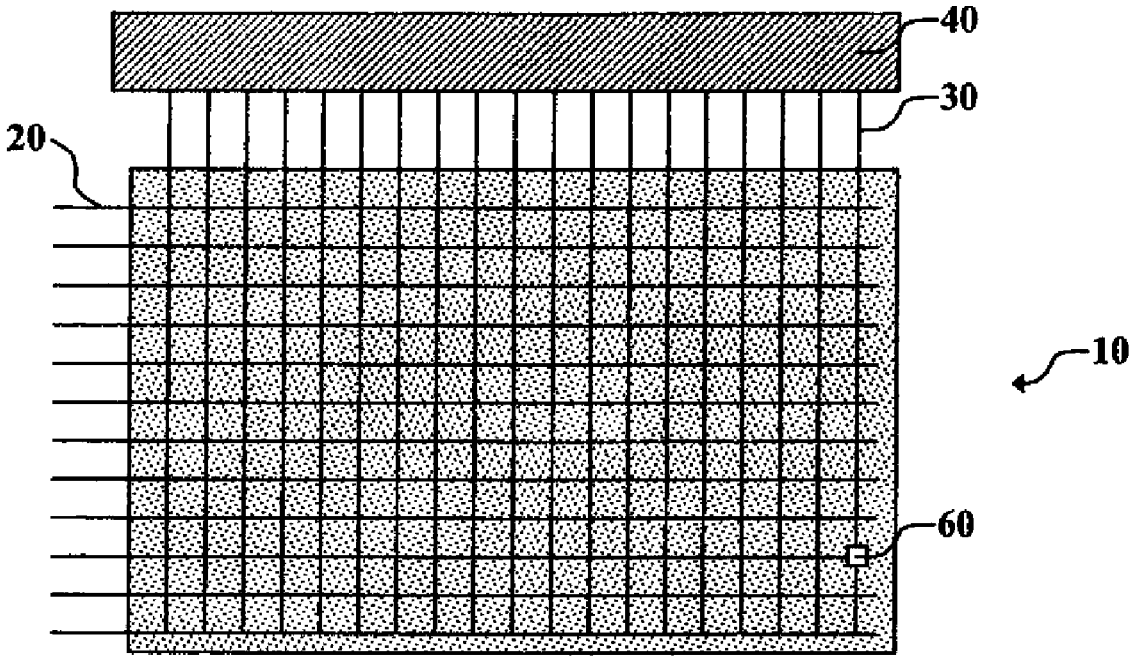
FIG. 1 is a schematic diagram of one embodiment of an electroluminescent (EL) display that can be used in the practice of the present invention.

Turning to FIG. 1, there is shown a schematic diagram of one embodiment of an electroluminescent (EL) display that can be used in the practice of the present invention. EL display 10 includes an array of a plurality of EL subpixels 60 arranged in rows and columns. EL display 10 includes a plurality of row select lines 20 wherein each row of EL subpixels 60 has a corresponding select line 20. EL display 10 further includes a plurality of readout lines 30 wherein each column of EL subpixels 60 has a corresponding readout line 30. Although not shown for clarity of illustration, each column of EL subpixels 60 also has a data line as well-known in the art. The plurality of readout lines 30 is connected to one or more multiplexers 40, which permits parallel/sequential readout of signals from EL subpixels, as described below. Multiplexer 40 can be a part of the same structure as EL display 10, or can be a separate construction that can be connected to or disconnected from EL display 10.

Figure 2:
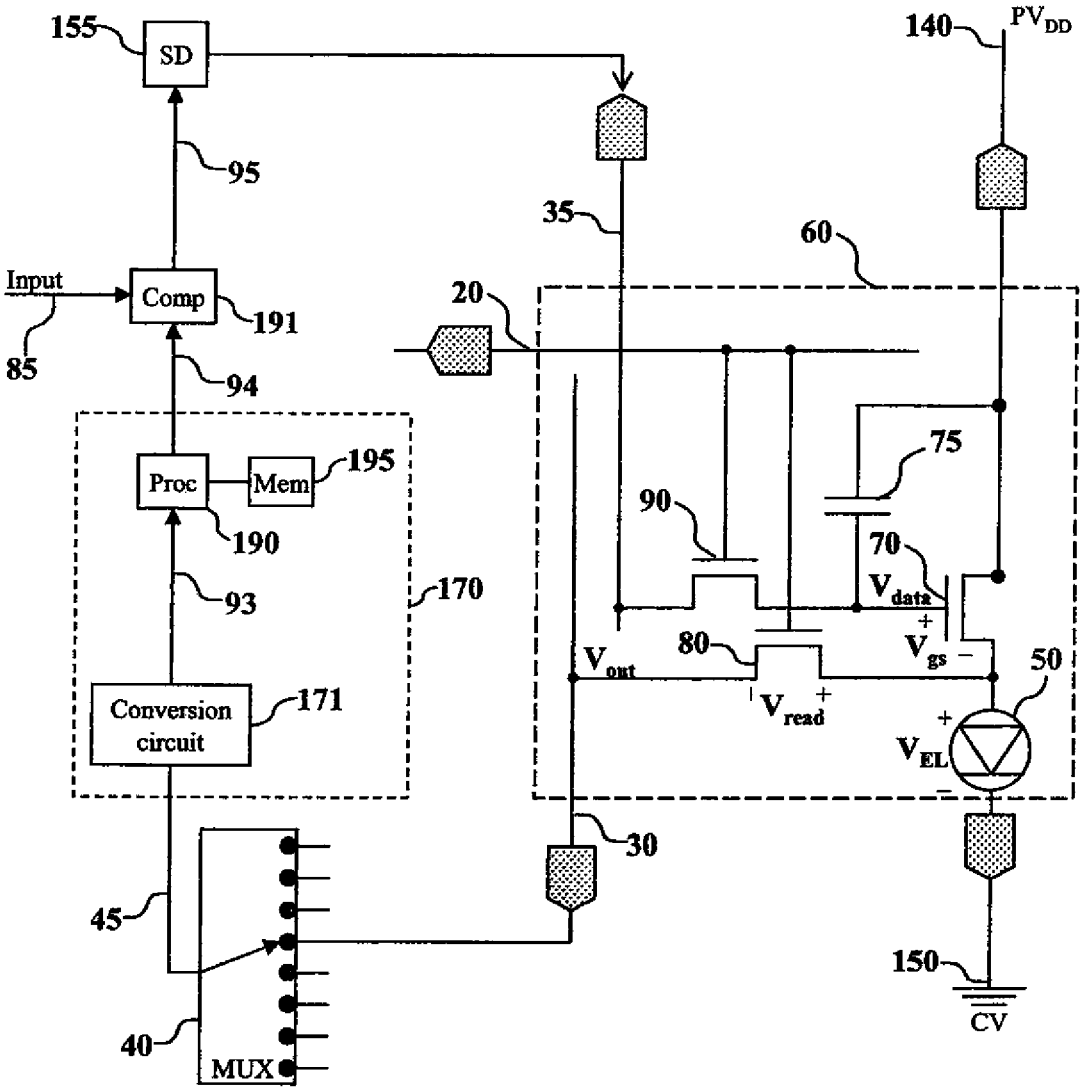
FIG. 2 is a schematic diagram of one embodiment of an EL subpixel and associated circuitry that can be used in the practice of the present invention.

Turning now to FIG. 2, there is shown a schematic diagram of one embodiment of an EL subpixel and associated circuitry that can be used in the practice of the present invention. EL subpixel 60 includes an EL emitter 50, a drive transistor 70, a capacitor 75, a readout transistor 80, and a select transistor 90. Each of the transistors has a first electrode, a second electrode, and a gate electrode. A first voltage source 140 is connected to the first electrode of drive transistor 70. By connected, it is meant that the elements are directly connected or connected via another component, e.g. a switch, a diode, another transistor, etc. The second electrode of drive transistor 70 is connected to a first electrode of EL emitter 50, and a second voltage source 150 is connected to a second electrode of EL emitter 50. Select transistor 90 connects a data line 35 to the gate electrode of drive transistor 70 to selectively provide data from data line 35 to drive transistor 70 as well-known in the art. Each row select line 20 is connected to the gate electrodes of the select transistors 90 and of the readout transistors 80 in the corresponding row of EL subpixels 60.

The first electrode of readout transistor 80 is connected to the second electrode of drive transistor 70 and also to the first electrode of EL emitter 50. Each readout line 30 is connected to the second electrodes of the readout transistors 80 in the corresponding column of EL subpixels 60. Readout line 30 provides a readout voltage to measurement circuit 170, which measures the readout voltage to provide status signals representative of characteristics of EL subpixel 60.

A plurality of readout lines 30 can be connected to measurement circuit 170 through a multiplexer-output line 45 and multiplexer 40 for sequentially reading out the voltages from the second electrodes of the respective readout transistors of a predetermined number of EL subpixels 60. If there are a plurality of multiplexers 40, each can have its own multiplexer-output line 45. Thus, a predetermined number of EL subpixels can be driven simultaneously. The plurality of multiplexers will permit parallel reading out of the voltages from the various multiplexers 40, while each multiplexer would permit sequential reading out of the readout lines 30 attached to it. This will be referred to herein as a parallel/sequential process.

Measurement circuit 170 includes a conversion circuit 171 and optionally a processor 190 and a memory 195. Conversion circuit 171 receives a readout voltage on multiplexer-output line 45 and outputs digital data on a converted-data line 93. Conversion circuit 171 preferably presents a high input impedance to multiplexer-output line 45. The readout voltage measured by conversion circuit 171 can be equal to the voltage on the second electrode of readout transistor 90, or can be a function of that voltage. For example, the readout voltage measurement can be the voltage on the second electrode of readout transistor 90, minus the drain-source voltage of the readout transistor and the voltage drop across the multiplexer 40. The digital data can be used as a status signal, or the status signal can be computed by processor 190 as will be described below. The status signal represents the characteristics of the drive transistor and EL emitter in the EL subpixel 60. Processor 190 receives digital data on converted-data line 93 and outputs the status signal on a status line 94. Processor 190 can be a CPU, FPGA or ASIC, and can optionally be connected to memory 195. Memory 195 can be non-volatile storage such as Flash or EEPROM, or volatile storage such as SRAM.

A compensator 191 receives the status signal on status line 94 and an input code value on an input line 85, and provides a compensated code value on a control line 95. A source driver 155 receives the compensated code value and produces a drive transistor control signal on data line 35. Thus, processor 190 can provide compensated data as will be described herein during the display process. As known in the art, the input code value can be provided by a timing controller (not shown). The input code value can be digital or analog, and can be linear or nonlinear with respect to commanded luminance. If analog, the input code value can be a voltage, a current, or a pulse-width modulated waveform.

Source driver 155 can includes a digital-to-analog converter or programmable voltage source, a programmable current source, or a pulse-width modulated voltage ("digital drive") or current driver, or another type of source driver known in the art.

Processor 190 and compensator 191 can be implemented on the same CPU or other hardware. Processor 190 and compensator 191 can together provide predetermined data values to data line 35 during the measurement process to be described herein.

Figure 3A:
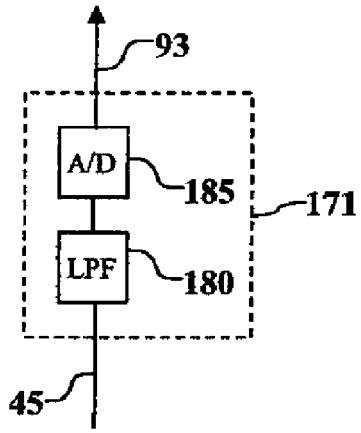
FIG. 3A is a schematic diagram of a first embodiment of a conversion circuit that can be used in the practice of the present invention.

Referring to FIG. 3A, in a first embodiment, conversion circuit 171 includes an analog-to-digital converter 185 for converting readout voltage measurements on multiplexer-output line 45 into digital signals. Those digital signals are provided to processor 190 on converted-data line 93. Conversion circuit 171 can also include a low-pass filter 180. In this embodiment, a predetermined test data value is provided to data line 35 by compensator 191 and the corresponding readout voltage on multiplexer-output line 45 is measured and used as the status signal.

Figure 3B:
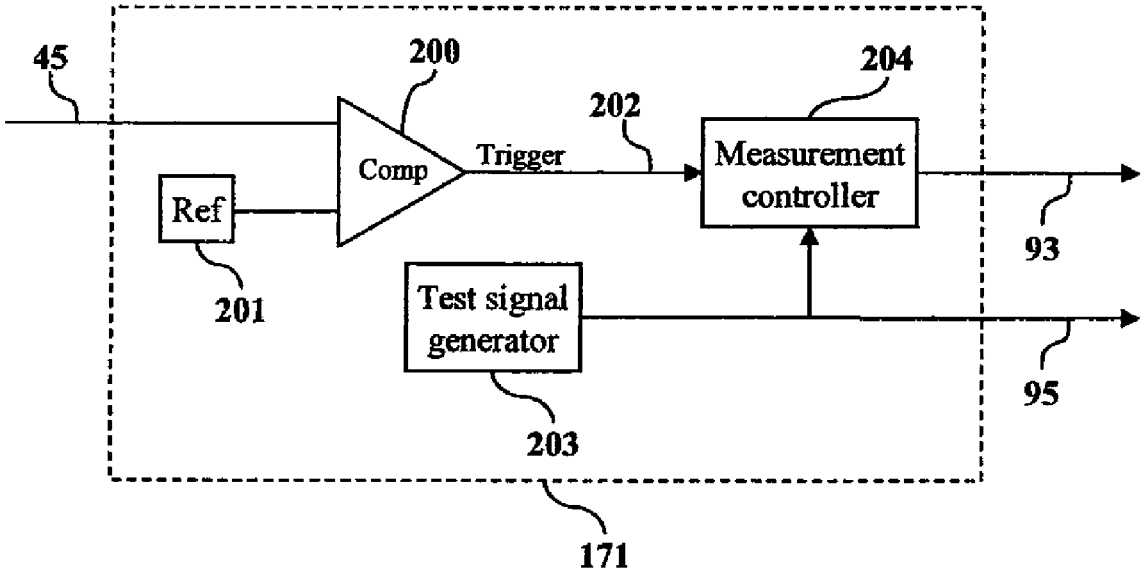
FIG. 3B is a schematic diagram of a second embodiment of a conversion circuit that can be used in the practice of the present invention.

Referring to FIG. 3B, in a second embodiment, conversion circuit 171 includes a voltage comparator 200, which compares the readout voltage measurement on multiplexer-output line 45 with a selected reference voltage level to provide a trigger signal on a trigger line 202 indicating the readout voltage is at or above, or at or below, the selected reference voltage level. The selected reference voltage level is provided by a reference voltage source 201. The readout voltage measurement corresponds to the voltage on readout line 30. To receive a readout voltage measurement, a test signal generator 203 sequentially provides a selected sequence of test voltages to the gate electrode of the drive transistor. Test signal generator 203 can be a ramp generator, in which case the selected sequence of test voltages is a nonincreasing or nondecreasing sequence. The nonincreasing sequence and the nondecreasing sequence cannot be constant. The sequence of test voltages is also provided to a measurement controller 204, which receives the trigger signal from voltage comparator 200 and the corresponding test voltage from test signal generator 203, and provides the corresponding test voltage on converted-data line 93 to the processor. The processor can provide the corresponding test voltage on status line 95 as the status signal to the compensator. Measurement controller 204 can also provide as the status signal a function, for example a linear transformation, of the corresponding test voltage. This embodiment can be implemented less expensively than the first embodiment as it does not require an analog-to-digital converter. The sequence of test voltages can be provided to the measurement controller 204 as equivalent digital code values or another form mapping to the test voltages. In this embodiment, the sequence of test voltages is provided to data line 35 by compensator 191, which receives the sequence from test signal generator 203 on control line 95, and the point at which the readout voltage on multiplexer-output line 45 crosses the threshold defined by reference voltage 201 is recorded and used as the status signal.

While measurements are being taken, test data values can command the emission of light from the EL emitter. This can be undesirably visible to a user of the EL display. Drive transistors 70, as known in the art, have a threshold voltage $V_{th}$ below which (or, for P-channel, above which) relatively little current flows, and so relatively little light is emitted. The selected reference voltage level can be less than the threshold voltage to prevent user-visible light from being emitted during measurement.

When drive transistor 70 is an amorphous silicon transistor, the threshold voltage $V_{th}$ is known to change under aging conditions, including actual usage conditions. Driving current through EL emitter 50 thus leads to an increase in $V_{th}$ of drive transistor 70. Therefore, a constant signal on the gate electrode of drive transistor 70 will cause a gradually decreasing current $I_{ds}$, and thus a gradually decreasing light intensity emitted by EL emitter 50. The amount of such decrease will depend upon the use of drive transistor 70; thus, the decrease can be different for different drive transistors in a display. This is one type of spatial variation in characteristics of EL subpixels 60. Such spatial variation can include differences in brightness and color balance in different parts of the display, and image "burn-in" wherein an often-displayed image (e.g. a network logo) can cause a ghost of itself to always show on the active display. It is desirable to compensate for such changes in the threshold voltage to prevent such problems. Also, there can be age-related changes to EL emitter 50, e.g. luminance efficiency loss and an increase in resistance across EL emitter 50.

Figure 4A:
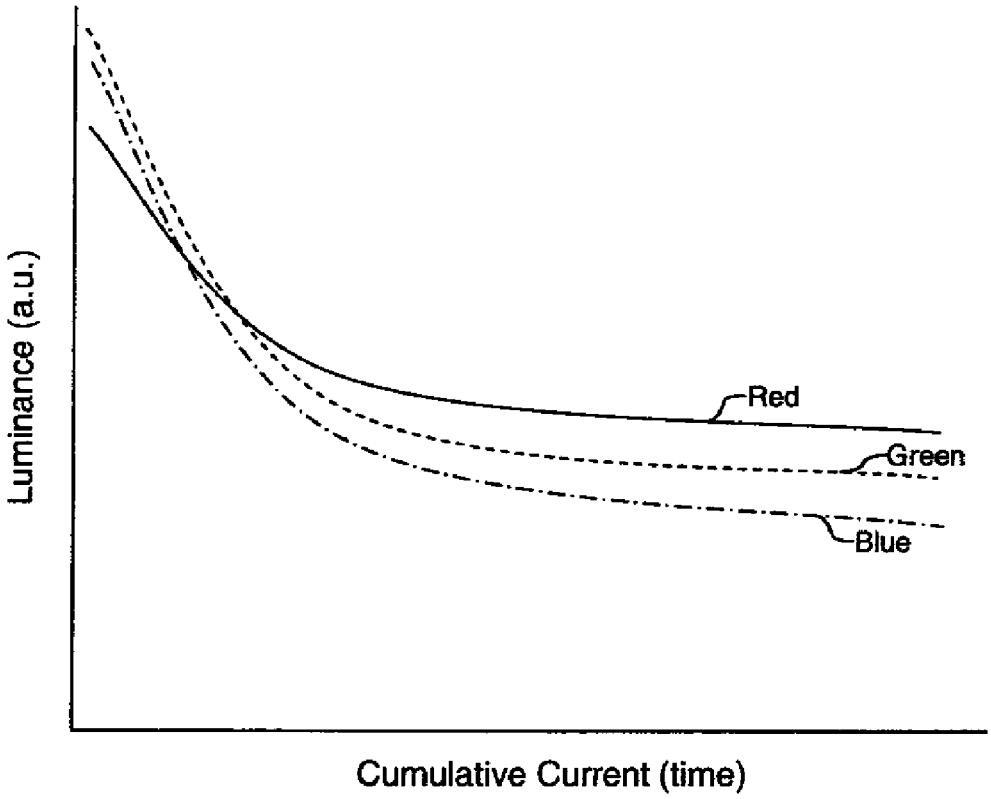
FIG. 4A is a diagram illustrating the effect of aging of an OLED emitter on luminance efficiency.

Turning now to FIG. 4A, there is shown a diagram illustrating the effect of aging of an OLED emitter on luminance efficiency as current is passed through the OLED emitters. The three curves represent typical performance of different light emitters emitting differently colored light (e.g. red, green and blue light emitters, respectively) as represented by luminance output over time or cumulative current. The decay in luminance between the differently colored light emitters can be different. The differences can be due to different aging characteristics of materials used in the differently colored light emitters, or due to different usages of the differently colored light emitters. Hence, in conventional use, with no aging correction, the display can become less bright and the color of the display—in particular the white point—can shift.

A further type of spatial variation is initial nonuniformity. The operating life of an EL display is the time from when an end user first sees an image on that display to the time when that display is discarded. Initial nonuniformity is any nonuniformity present at the beginning of the operating life of a display. The present invention can advantageously correct for initial nonuniformity by taking measurements before the operating life of the EL display begins. Measurements can be taken in the factory as part of production of a display. Measurements can also be taken after the user first activates a product containing an EL display, immediately before showing the first image on that display. This permits the display to present a high-quality image to the end user when he first sees it, so that his first impression of the display will be favorable.

Figure 4B:
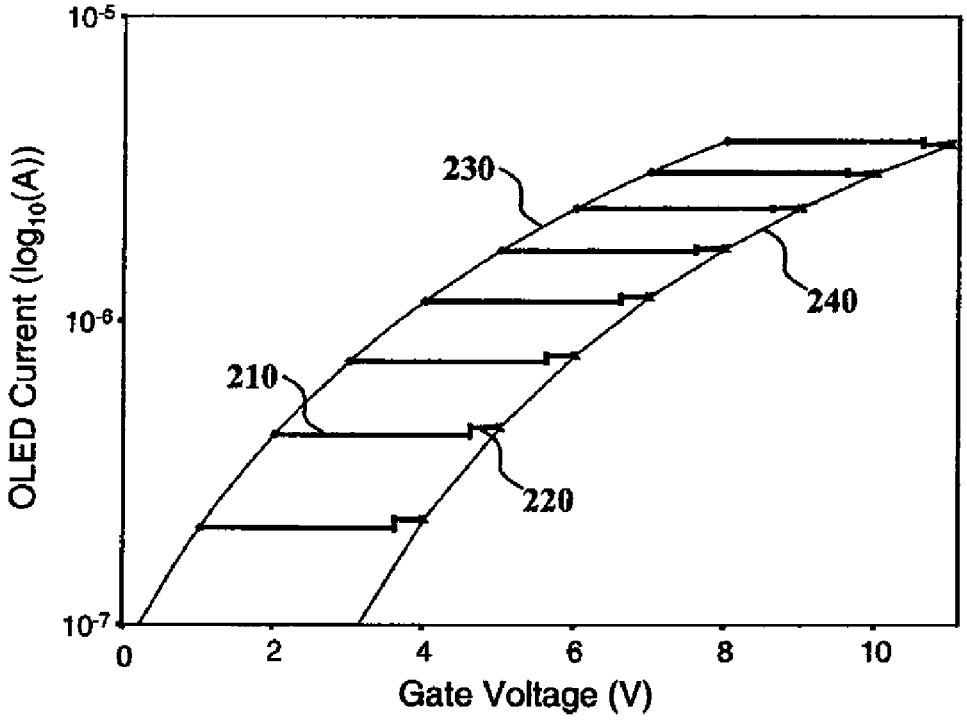
FIG. 4B is a diagram illustrating the effect of aging of an OLED emitter or a drive transistor on device current.

Turning to FIG. 4B, there is shown a diagram illustrating the effect of differences in characteristics of two EL emitters or drive transistors, or both, on EL subpixel current. This figure can also represent the analogous case of a single EL subpixel before and after aging. The abscissa of FIG. 3 represents the gate voltage at drive transistor 70. The ordinate is the base-10 logarithm of the current through the EL emitter 50. A first EL subpixel I-V characteristic 230 and a second EL subpixel I-V characteristic 240 show the I-V curves for two different EL subpixels 60, or for a single EL subpixel 60 before aging (230) and after aging (240). For characteristic 240, a greater voltage is required than for characteristic 230 to obtain a desired current; that is, the curve is shifted right by an amount ΔV. For aging, ΔV is the sum of the change in threshold voltage ($\Delta V_{th}$, 210) and the change in EL voltage resulting from a change in EL emitter resistance ($\Delta V_{EL}$, 220), as shown. This change results in nonuniform light emission between the subpixels having characteristics 230 and 240, respectively: a given gate voltage will control less current, and therefore less light, on characteristic 240 than on characteristic 230.

The relationship between the OLED current $I_{EL}$ (which is also the drain-source current $V_{ds}$ through the drive transistor), OLED voltage $V_{EL}$, and threshold voltage at saturation $V_{th}$ is:

$$I_{EL} = I_{ds} = \frac{W\mu C_0}{2L}(V_{gs} - V_{th})^2 = \frac{K}{2}(V_g - V_{EL} - V_s - V_{th})^2 \quad \text{(Eq. 1)}$$

where W is the TFT Channel Width, L is the TFT Channel Length, μ is the TFT mobility, $C_0$ is the Oxide Capacitance per Unit Area, $V_g$ is the gate voltage, and $V_{gs}$ is voltage difference between gate and source of the drive transistor. For simplicity, we neglect dependence of μ on $V_{gs}$. Thus, to compensate for variations in characteristics of one or a plurality of EL subpixels 60, one must correct for change in $V_{th}$ and $V_{EL}$. However, taking multiple measurements can be very time-consuming. The present invention advantageously reduces measurement time by correcting for transistor and EL emitter variations with one measurement.

Figure 5A:
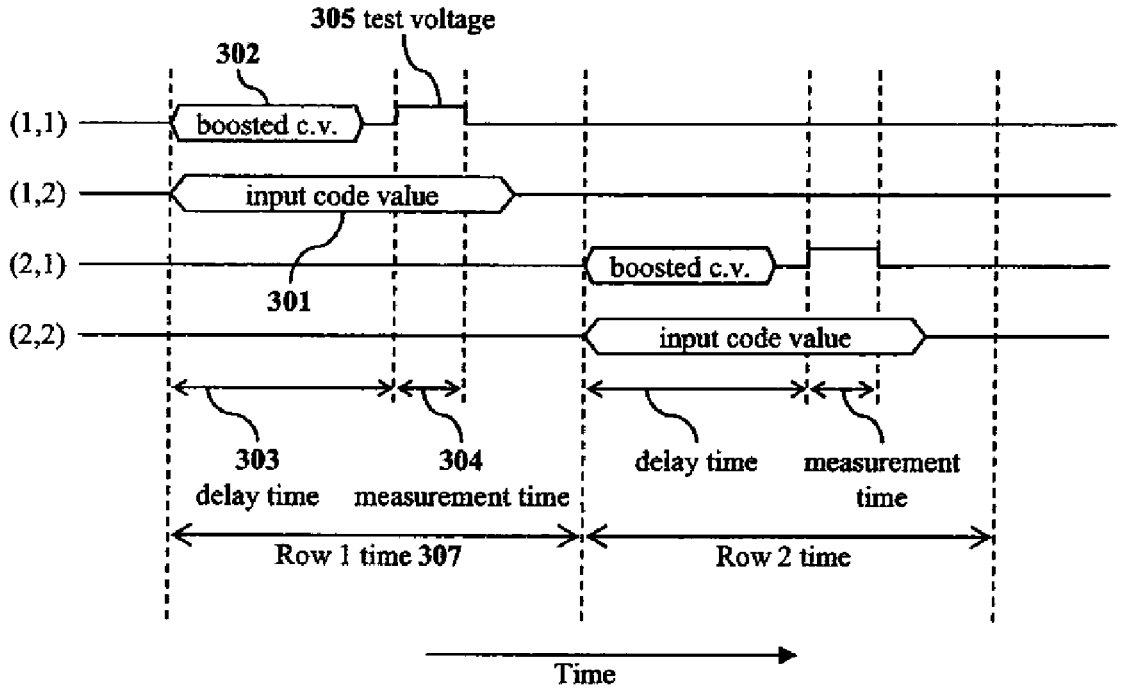
FIG. 5A is a row timing diagram of one embodiment of the method of the present invention.

Referring to FIG. 5A and also to FIGS. 2 and 3A, there is shown a timing diagram of the first embodiment given above of the present invention. Time increases to the right. Timing is shown for two sub pixels, addressed as (row,col): (1,1) and (1,2) in row 1, and (2,1) and (2,2) in row 2. This diagram shows timing with non-overlapping rows for clarity, but in practice the row times would overlap as known in the art, and as will be shown in FIG. 5C.

For each subpixel, compensator 191 receives a corresponding input code value on input line 85 which commands a corresponding light output from the respective subpixel. Shown on the timing diagram of FIG. 5A are analog data signals from source driver 155 corresponding to the input code values. Starting with row 1, a target subpixel is selected: (1,1). A boosted code value is calculated which commands a selected first amount higher light output than the input code value for the target subpixel. The boosted code value is provided to the target subpixel (1,1) in boosted code value period 302, and all other subpixels, here (1,2), have provided to them their corresponding input code values (input code value period 301). After a selected delay time 303, the boosted code value period 302 ends for the target subpixel, and measurement time 304 begins. During measurement time 304, the target subpixel is driven with a selected test voltage 305 and a measurement is taken of the voltage on the second electrode of the readout transistor of the target subpixel using analog-to-digital converter 185, as described above.

Figure 5B:
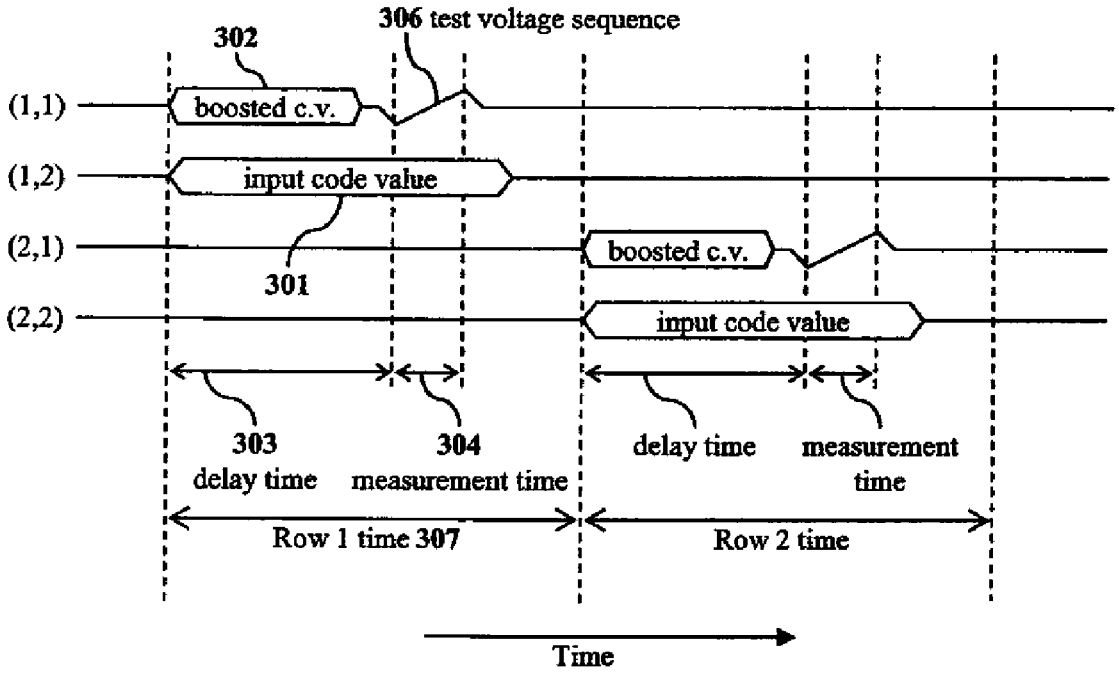
FIG. 5B is a row timing diagram of another embodiment of the method of the present invention.

Referring to FIG. 5B and also to FIGS. 2 and 3B, there is shown a timing diagram of the second embodiment given above of the present invention. Boosted code value period 302, input code value period 301, selected delay time 303, and measurement time 304 are as described on FIG. 3A. During measurement time 304, the target subpixel is driven with a selected sequence of test voltages 306 provided by test signal generator 203 and a measurement is taken of the voltage on the second electrode of the readout transistor using comparator 200, as described above.

As shown on FIGS. 5A and 5B, the measurement process is repeated for each row in a selected order. During any selected row time, any number of the subpixels may be selected as target subpixels.

The boosted code value period 302 prevents measurements from being visible by equalizing the light output of the target subpixel and the other subpixels. During the boosted code value period, the target subpixel can be driven at a higher output level to balance the shorter time it is on. Delay time 303 can be a selected percentage of a selected row time 307. The selected first amount is then a percentage of the output commanded by the corresponding input code value, and can be calculated as the reciprocal of the selected percentage. For example, if the delay time 303 is 0.8 (4/5) of row time 307, the selected first amount is 1/0.8=5/4=1.25. A 20% reduction in time available requires a 25% increase in luminance to produce the same total light output (100% output for one row time=1*1=1; 125% output for 0.8 row times=1.25*0.8=1).

Figure 5C:
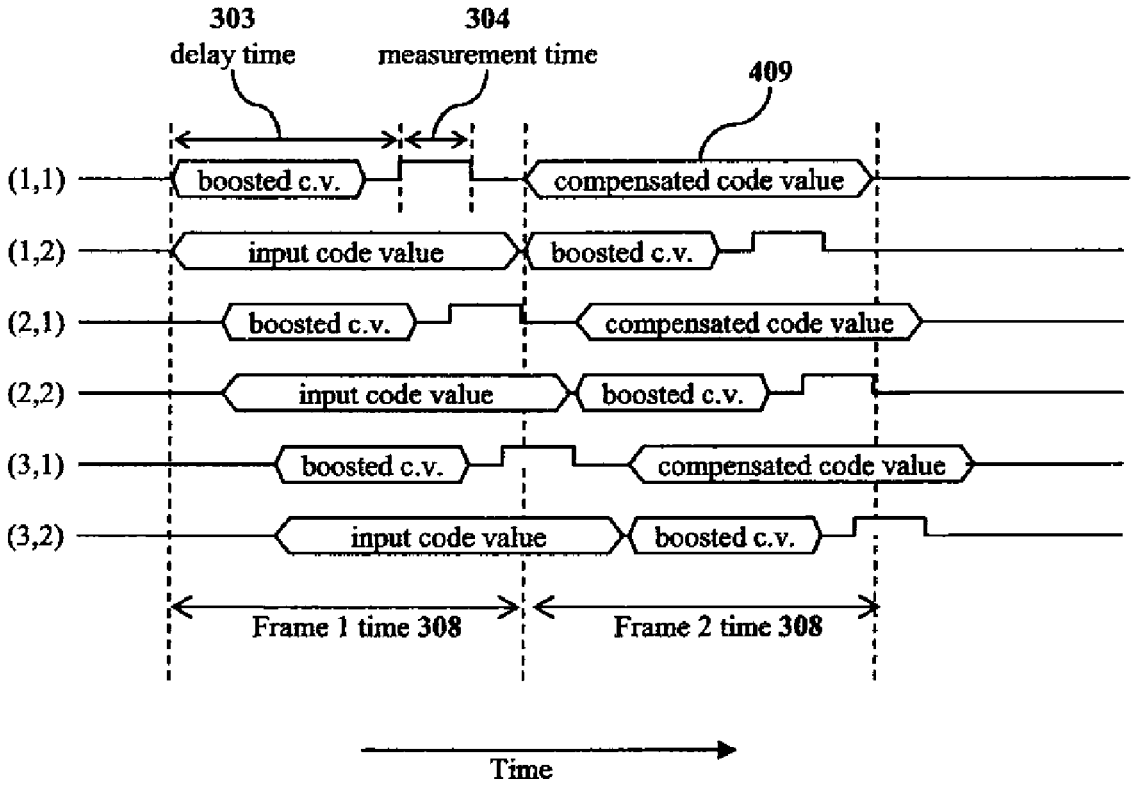
FIG. 5C is a frame timing diagram of an embodiment of the method of the present invention.

Referring to FIG. 5C, in practice, as known in the art, row times overlap in frame times 308, and delay time 303 is a selected percentage of a selected frame time, which can be for example 16.7 ms (=1/60 sec.). The measurement time 304 can be before the delay time 303 instead of after. FIG. 5C shows the subpixel in column 1 of each row selected as the target subpixel during the first frame, and the subpixel in column 2 of each row selected as the target subpixel during the second frame. During the second frame, the readout voltage measurement taken during the first frame is used by compensator 191 to produce a compensated code value which is provided during compensated code value period 409 to the subpixel which was the target in frame 1.

Figure 5D:
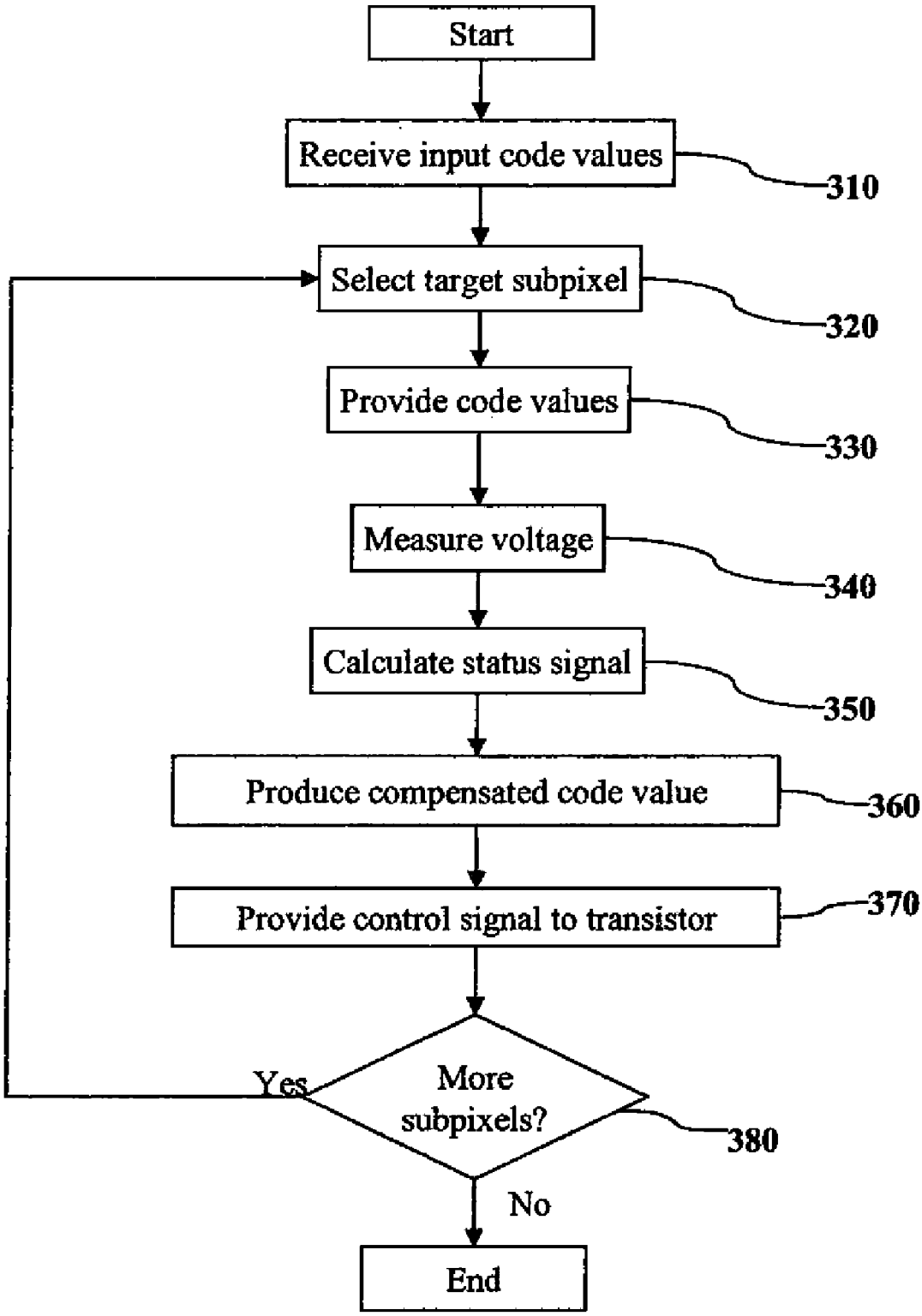
FIG. 5D is a flowchart of one embodiment of the method of the present invention.

Turning now to FIG. 5D, and referring also to FIG. 2, there is shown a block diagram of one embodiment of the method of the present invention. As described above, input code values are received (Step 310), a target subpixel is selected (Step 320), input code values and boosted code values are provided to the subpixels as described above (Step 330), and a measurement is taken of the voltage on the second electrode of the readout transistor of the target subpixel (Step 340). A status signal is then provided representing the characteristics of the drive transistor and EL emitter in the target subpixel (Step 350).

The status signal can represent aging: variations in the characteristics of the drive transistor 70 and EL emitter 50 in the target subpixel 60 caused by operation of the drive transistor and EL emitter in that subpixel over time. To calculate such a status signal, in either embodiment of conversion circuit 171 described above, a first readout voltage measurement can be taken of each subpixel and stored in memory 195 by processor 190. This measurement can be taken before the operating life of the EL display. During operation of the EL display, at a different, later time than the time at which the first readout voltage measurement was taken, a second readout voltage measurement can be taken of each subpixel and stored in memory 195. The first and second readout voltage measurements can then be used to compute a status signal representing variations in the characteristics of the drive transistor and EL emitter caused by operation of the drive transistor and EL emitter over time. For example, the status signal can then be calculated as the difference between the second readout voltage measurement and the first readout voltage measurement, or as a function of that difference, such as a linear transform.

The status signal is then provided to compensator 191, which provides a compensated code value for the target subpixel using the status signal and the input code value (Step 360). The operation of the compensator will be discussed further below.

A drive transistor control signal corresponding to the compensated code value is then provided to the drive transistor of the target EL subpixel. The compensator provides the compensated code value to source driver 155, which produces the drive transistor control signal and provides it via data line 35 and select transistor 80 to the gate electrode of drive transistor 70 (step 370).

Steps 320 through 370 are then repeated (decision step 380) until each of the plurality of subpixels in turn has been selected as the target subpixel and respective drive transistor control signals have been provided to the respective drive transistors in each of the plurality of EL subpixels. Once the readout voltage has been measured for a subpixel, the corresponding status signal can be stored in memory 195. The compensator 191 can use that stored status signal to compensate any number of input code values. Measurements can be taken at regular intervals, each time the display is powered up or down, or at intervals determined by the usage of the display. Measurements can also be taken throughout the life of the display as the boosted code value 302 prevents the measurement period 304 from being visible to the user. Subpixels can be selected to be the target subpixel in any order. In one embodiment, they can be selected from top to bottom, according to the row scanning order of the display, and from left to right or right to left. In another embodiment, target subpixels can be selected at random positions in each row to prevent systematic bias due to factors such as temperature gradients.

Referring back to FIG. 2, voltage $V_{out}$ is measured (in the first embodiment) or selected (in the second embodiment). Voltage $V_{data}$ is known (in the first embodiment) or measured (in the second embodiment). Voltage $V_{read}$, the drop across the readout transistor, can be assumed to be constant as very little current flows through the readout transistor into the high input impedance of conversion circuit 171. Voltages PVDD and CV are selected. $V_{EL}$ can therefore be calculated as $$V_{EL}=(V_{out}+V_{read})-CV \quad \text{(Eq. 2)}$$

Variations in the characteristics of the drive transistors and EL devices in the EL subpixels are reflected in variations in the calculated $V_{EL}$. $V_{EL}$ can thus be used as a status signal. Before mass-production of EL display 10, one or more representative devices can be characterized to produce an product model mapping $V_{EL}$ for each subpixel to the corresponding transistor ($V_{th}$, mobility) and EL device (resistance, efficiency) characteristics. More than one product model can be created. For example, different regions of the display can have different product models. The product model can be stored in a lookup table or used as an algorithm.

In one embodiment, particularly useful for initial-nonuniformity compensation, a reference status signal level can be selected. This level can be the mean, minimum or maximum of the status signals for all subpixels, or another function as will be obvious to those skilled in the art. The compensator can compare each subpixel's respective status signal to the reference status signal level to determine how much compensation to apply. This can be useful when compensating for initial nonuniformity, in which case a second readout voltage measurement is not available. The compensator can use the product model with the measured $V_{EL}$ values and the selected reference status signal level to produce the compensated code values.

Figure 6:
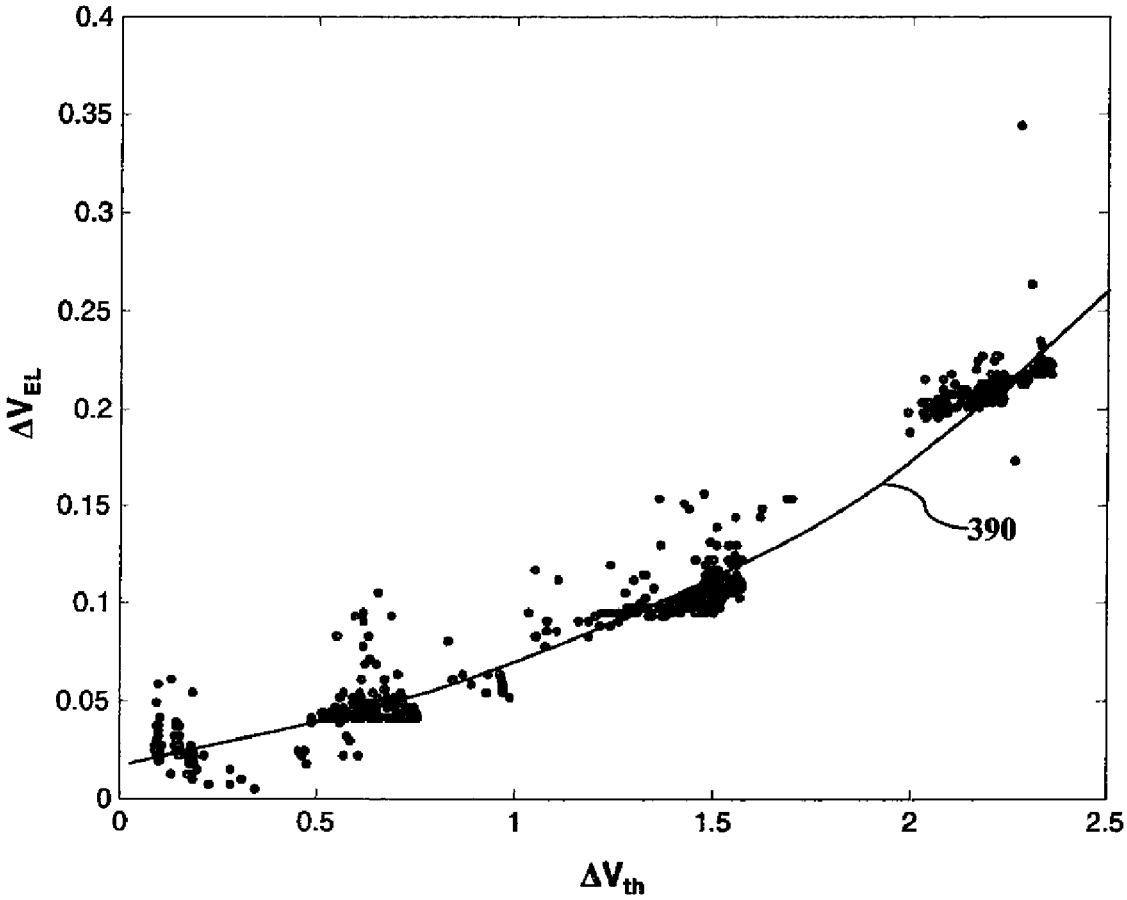
FIG. 6 is a graph showing the relationship between change in transistor threshold voltage and change in OLED voltage

In one embodiment for aging compensation according to the present invention, the difference $\Delta V_{EL}$ between $V_{EL}$ at the second readout voltage measurement and $V_{EL}$ at the first readout voltage measurement is used as the status signal. Amorphous silicon TFT aging and OLED aging are both proportional to the integrated current passed through the devices over time, so a model can be made correlating $\Delta V_{EL}$ with $\Delta V_{th}$ of the transistors and compensation performed. FIG. 6 shows an example of correlation between $\Delta V_{EL}$ on the abscissa and $\Delta V_{th}$ on the ordinate. This correlation can be incorporated into the product model by regression techniques known in the statistical art; curve 390 shows one possible spline fit.

In the case of FIG. 2, transistor and OLED aging require the compensated code value to be higher than the input code value by $\Delta V_{th}$, and by a correction for the channel-length modulation of drive transistor 70 due to OLED voltage rise $\Delta V_{EL}$, which reduces $V_{ds}$ of drive transistor 70.

Figure 7:
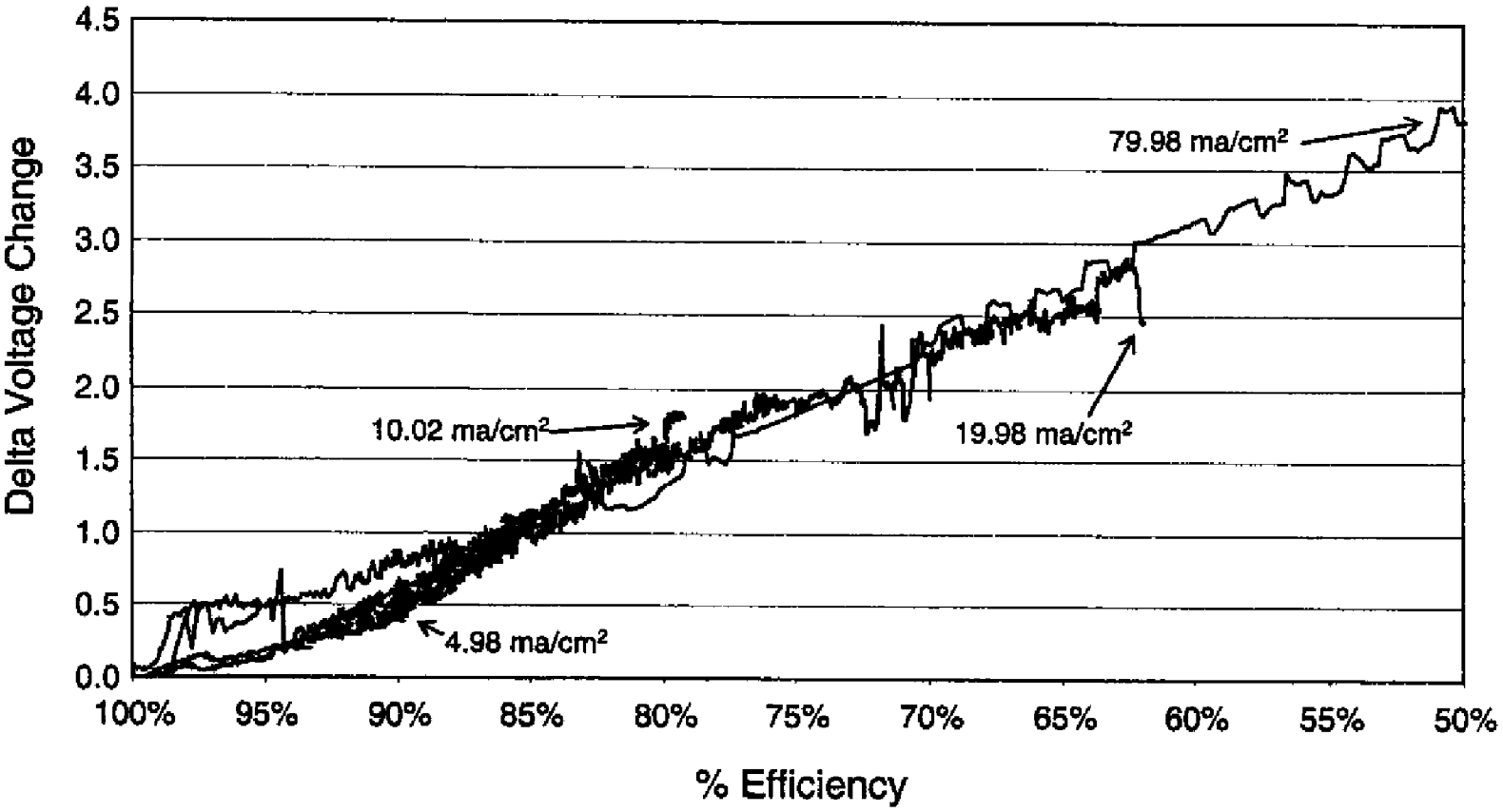
FIG. 7 is a graph showing the relationship between OLED efficiency and the change in OLED voltage.

An additional effect in aging compensation is OLED efficiency loss. An example of the relationship between luminance efficiency and $\Delta V_{EL}$ for one device is shown in the graph in FIG. 7. By measuring the luminance decrease and its relationship to $\Delta V_{EL}$ with a given current, a change in corrected signal necessary to cause the EL emitter 50 to output a nominal luminance can be determined. This relationship can be incorporated in the product model.

To compensate for the changes or variations in characteristics of EL subpixel 60, one can use the status signals in an equation of the form:

$$V_{comp}=V_{data}+f_1(\Delta V_{EL})+f_2(\Delta V_{EL})+f_3(\Delta V_{EL}, V_{data}) \quad \text{(Eq. 3)}$$

where $V_{comp}$ is a voltage corresponding to the compensated code value necessary to maintain the desired luminance of EL subpixel 60, $V_{data}$ is a voltage corresponding to the input code value, $f_1(\Delta V_{EL})$ is a correction for the change in threshold voltage, $f_2(\Delta V_{EL})$ is a correction for the change in EL resistance, and $f_3(\Delta V_{EL}, V_{data})$ is a correction for the change in EL efficiency. Function $f_3$ will be described further below. Functions $f_1$, $f_2$ and $f_3$ are components of the product model. Using this equation, compensator 191 can control EL emitter 60 to achieve constant luminance output and increased lifetime at a given luminance. Because this method provides a respective correction for each EL subpixel in EL display 10, it will compensate for spatial variations in the characteristics of the plurality of EL subpixels.

Figure 8:
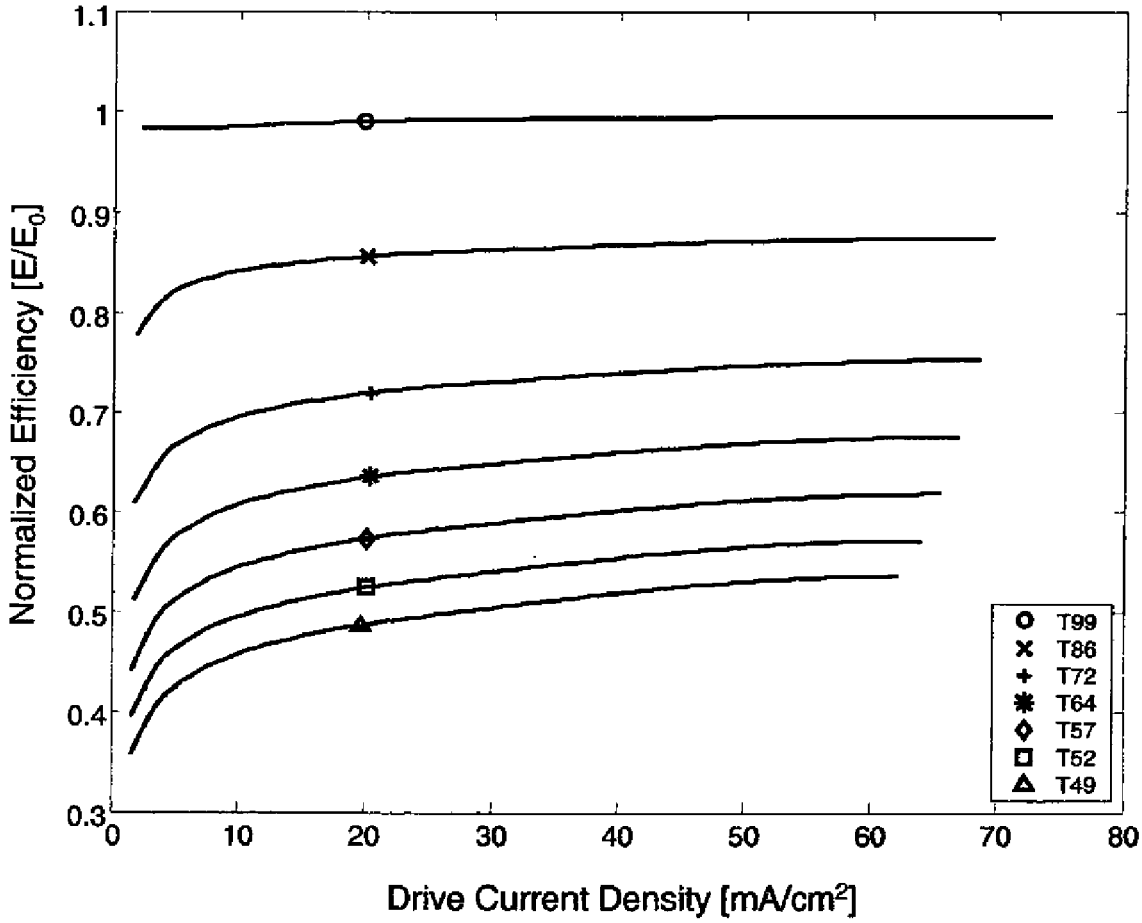
FIG. 8 is a graph showing the relationship between OLED efficiency, OLED age, and OLED drive current density.
Figure 9:
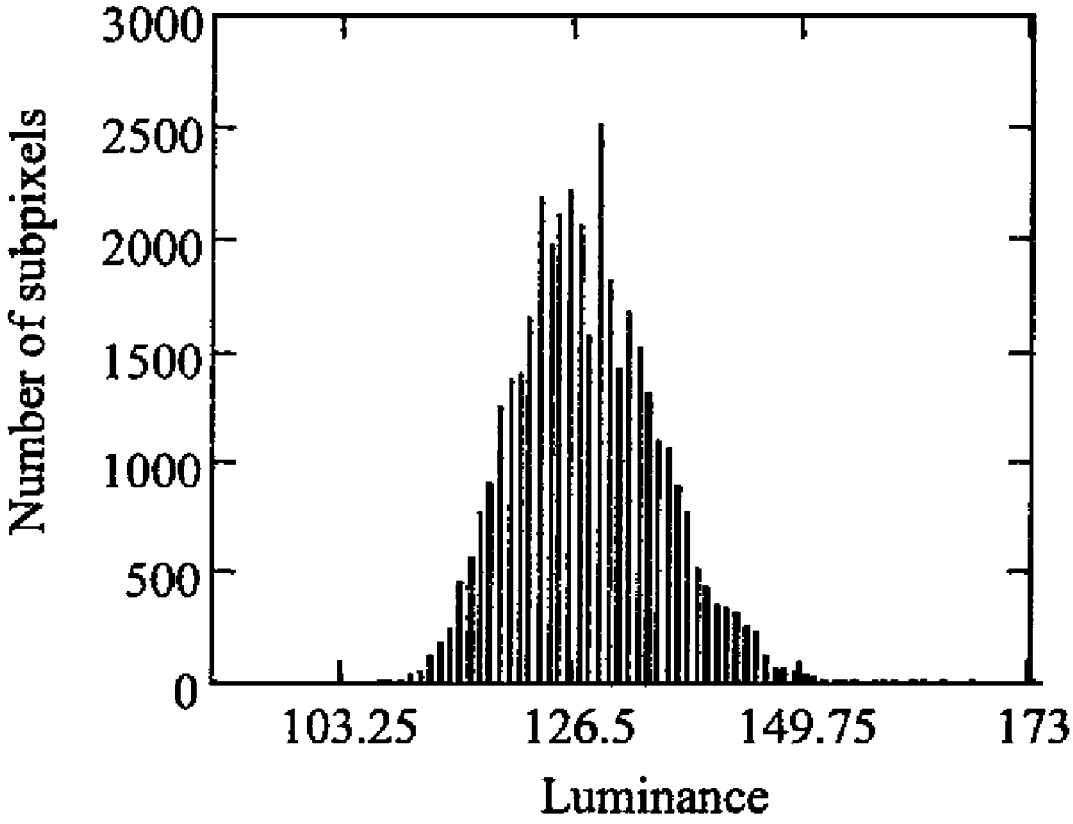
FIG. 9 is a histogram of pixel luminance exhibiting differences in characteristics between pixels.

FIG. 8 shows an example model of $f_3$, referred to in Eq. 3. The efficiency of an OLED emitter depends not only on its age, represented by status signal $\Delta V_{EL}$, but also on the level to which it is being driven, represented by $V_{data}$. FIG. 8 shows curves of efficiency versus drive level for seven different aging levels. The aging levels are identified, as known in the art, as "Txx", where "xx" is the percent efficiency at a specified test level, in this case 20 mA/cm$^2$. Compensator 191 can produce the compensated code value in response to the status signal and to the input code value to compensate correctly for the variations in the efficiency of the EL emitter at any drive level.

In a preferred embodiment, the invention is employed in a display that includes Organic Light Emitting Diodes (OLEDs) which are composed of small molecule or polymeric OLEDs as disclosed in but not limited to U.S. Pat. No. 4,769,292, by Tang et al., and U.S. Pat. No. 5,061,569, by VanSlyke et al. Many combinations and variations of organic light emitting displays can be used to fabricate such a display. Referring to FIG. 2, when EL emitter 50 is an OLED emitter, EL subpixel 60 is an OLED subpixel.

Transistors 70, 80 and 90 can be amorphous silicon (a-Si) transistors, low-temperature polysilicon (LTPS) transistors, zinc oxide transistors, or other transistor types known in the art. They can be N-channel, P-channel, or any combination. The OLED can be a non-inverted structure (as shown) or an inverted structure in which EL emitter 50 is connected between first voltage source 140 and drive transistor 70.

The invention has been described in detail with particular reference to certain preferred embodiments thereof, but it will be understood that variations and modifications can be effected within the spirit and scope of the invention.

PARTS LIST

10 EL display
20 select line
30 readout line
35 data line
40 multiplexer
45 multiplexer-output line
50 EL device
60 EL subpixel
70 drive transistor
75 capacitor
80 readout transistor
85 input line
90 select transistor
93 converted-data line
94 status line
95 control line
140 first voltage source
150 second voltage source
155 source driver
170 measurement circuit
171 conversion circuit
180 low-pass filter
185 analog-to-digital converter
190 processor
191 compensator
195 memory
200 voltage comparator
201 reference voltage source
202 trigger line
203 test signal generator
204 measurement controller
210 $\Delta V_{th}$
220 $\Delta V_{EL}$
230 subpixel I-V characteristic
240 subpixel I-V characteristic
301 input code value period
302 boosted code value period
303 delay time
304 measurement time
305 test voltage
306 sequence of test voltages
307 row time
308 frame time
310 step
320 step
330 step
340 step
350 step
360 step
370 step
380 decision step
390 curve
409 compensated code value period

The invention claimed is:

1. A method of providing drive transistor control signals to drive transistors in a plurality of electroluminescent (EL) subpixels, the method comprising:

(a) providing a plurality of EL subpixels, each subpixel comprising:

a drive transistor comprising a first electrode, a second electrode, and a gate electrode;

an EL emitter comprising a first electrode and a second electrode; and readout transistor comprising a first electrode, a second electrode, and a gate electrode;

(b) connecting the first electrode of each readout transistor to the second electrode of the corresponding drive transistor and to the first electrode of the corresponding EL emitter;

(c) receiving for each subpixel an input code value which commands a corresponding output from the respective subpixel;

(d) selecting a target subpixel;

(e) providing to each subpixel, except the target subpixel, the respective input code value, and providing to the target subpixel a boosted code value which commands a selected first amount higher output than the corresponding input code value;

(f) after a selected delay time, measuring a readout voltage on the second electrode of the readout transistor of the target subpixel to provide a status signal representing characteristics of the drive transistor and EL emitter in that subpixel;

(g) using the status signal to provide a compensated code value for the target subpixel;

(h) providing a drive transistor control signal corresponding to the compensated code value to the drive transistor of the target EL subpixel; and (i) repeating operations (d) through (h), selecting each of the plurality of subpixels in turn as the target subpixel, to provide a respective drive transistor control signal to the drive transistor in each of the plurality of EL subpixels, wherein the selected delay time comprises a selected percentage of a selected frame time, wherein the selected first amount comprises a percentage of the output commanded by the corresponding input code value, and wherein the selected first amount comprises the reciprocal of the selected percentage.

2. The method of claim 1, wherein the EL emitter comprises an OLED emitter.

3. The method of claim 1, wherein the drive transistor comprises an amorphous silicon transistor.

4. The method of claim 1, further comprising:

providing a single readout line connected to the second electrodes of the readout transistors of all subpixels for providing a readout voltage; and providing for each EL subpixel a select line connected to the gate electrode of the corresponding readout transistor.

5. The method of claim 1, wherein operation (f) further comprises:

providing an analog to digital converter connected to the second electrode of the readout transistor of the target subpixel, wherein the analog to digital converter is used in providing an aging signal.

6. The method of claim 1, wherein operation (f) further comprises:

providing a voltage comparator connected to the second electrode of the readout transistor of the target subpixel for providing a trigger signal indicating the readout voltage is at or above a selected reference voltage level;

providing a test signal generator for sequentially providing a selected sequence of test voltages to the gate electrode of the drive transistor and to a measurement controller; and providing the measurement controller for receiving the trigger signal from the voltage comparator, and for using the corresponding test voltage to provide the aging signal to a compensator.

7. The method of claim 1, wherein the status signal represents variations in the characteristics of the drive transistor and EL emitter in the target subpixel caused by operation of the drive transistor and EL emitter in that subpixel over time.

8. The method of claim 7, wherein operation (f) comprises:

providing a memory;

storing in the memory a first readout voltage measurement of each subpixel;

storing in the memory a second readout voltage measurement of each subpixel; and using the stored first and second readout voltage measurements to provide the status signal to a compensator.

9. The method of claim 1, further comprising:

selecting a reference status signal level, wherein operation (g) comprises using the reference status signal level to provide the compensated code value for the target subpixel.

10. A method for controlling a first organic light-emitting diode (OLED) subpixel, the method comprising:

providing the first OLED subpixel, comprising:

a drive transistor comprising a first electrode, a second electrode, and a gate electrode, an emissive element comprising a first electrode and a second electrode, and a readout transistor comprising a first electrode, a second electrode, and a gate electrode;

connecting the first electrode of the readout transistor to the second electrode of the drive transistor and to the first electrode of the emissive element;

receiving first and second input code values which command corresponding first and second light outputs from the first subpixel and a second subpixel respectively;

driving a second transistor of the second subpixel according to the second code value;

driving the drive transistor according to a boosted code value, which commands a higher light output than the first light output, for a reduced first duration;

outside the reduced first duration, measuring a readout voltage on the second electrode of the readout transistor to provide a status signal representing characteristics of the drive transistor and the emissive element;

using the status signal to provide a corrected code value for the first subpixel; and driving the drive transistor according to the corrected code value for a normal first duration;

wherein a reduction from the normal first duration to the reduced first duration is proportionately compensated by a boost from the first light output to the higher light output.

11. The method of claim 10, wherein the measuring operation is performed with the drive transistor operated below threshold.

* * * * *